United States Patent [19]

Newman

[11] Patent Number: 4,738,629

[45] Date of Patent: Apr. 19, 1988

[54] ELECTRIC SOCKETS

[75] Inventor: John Newman, Buckinghamshire

[73] Assignee: Rotaflex PLC, London, England

[21] Appl. No.: 47,140

[22] Filed: May 8, 1987

Related U.S. Application Data

[62] Division of Ser. No. 731,316, May 7, 1985, Pat. No. 4,681,384.

[51] Int. Cl.[4] ..... H01R 13/44

[52] U.S. Cl. ..... 439/137; 439/140; 200/50 B

[58] Field of Search ..... 439/136, 137, 138, 142, 439/143, 145, 490; 200/50 B, 51.11

[56] References Cited

U.S. PATENT DOCUMENTS

| | | | |
|---|---|---|---|
| 4,272,142 | 6/1981 | Zapf | 439/490 |
| 4,528,429 | 7/1985 | Dobson et al. | 200/50 B |
| 4,549,778 | 10/1985 | Price et al. | 439/137 |
| 4,605,270 | 8/1986 | Aslizadeh | 439/140 |
| 4,650,268 | 3/1987 | Dobson et al. | 439/138 |
| 4,678,254 | 7/1987 | Le Magourore | 439/137 |
| 4,681,384 | 7/1987 | Newman | 439/137 |

FOREIGN PATENT DOCUMENTS

| | | | |
|---|---|---|---|
| 2012200 | 9/1971 | Fed. Rep. of Germany | 200/50 B |
| 724316 | 11/1966 | Italy | 200/50 B |

*Primary Examiner*—Gil Weidenfeld
*Assistant Examiner*—Paula A. Aust
*Attorney, Agent, or Firm*—Watson, Cole, Grindle & Watson

[57] ABSTRACT

An electric socket outlet is provided with an outer shutter (20) mounted slidably on the socket fascia (11) and movable between a closed position in which it covers and hides from view the openings (16–18) in the fascia through which the plug pins enter, and an open position in which the openings are uncovered. The shutter is received in a recess (14) in the fascia so that its front surface is flush with that of the fascia, and is biased to the closed position by a spring (25). A switch may be included and an interlock device provided to prevent the switch being turned on when there is no plug inserted in the socket and to ensure the switch is turned off when a plug is removed from the socket.

9 Claims, 4 Drawing Sheets

ELECTRIC SOCKETS

This application is a divisional application of application Ser. No. 731,316, filed May 7, 1985, now U.S. Pat. No. 4,681,384.

This invention relates to electricity supply systems and devices. More particularly the invention concerns an electric socket outlet adapted to receive a plug connector wired to an appliance for supplying electric power to that appliance.

In general outlet sockets have a fascia plate provided with a number of openings which provide access to the electrical contacts of the socket and into which respective contact pins of a plug are inserted when the plug is engaged with the socket. In some cases the socket contacts are freely accessible through the openings, which is potentially dangerous especially if the socket is mounted at or near floor level, since small children may push their fingers or sharp instruments into the openings and make contact with the live contacts. In an attempt to reduce these risks it is known to provide a shutter device within the socket behind the fascia plate. One form of shutter device comprises a shutter which is urged by a spring towards a closed position in which it covers the line contacts against access through the respective openings. The shutter has a tongue which in the closed position is located immediately behind the opening intended to receive the earth pin of the electric plug, and upon inserting the plug into the socket the earth pin engages the tongue and slides back the shutter to enable the current pins to enter into co-operation with the power contacts of the socket.

While the provision of such a shutter substantially improves safety, the problem mentioned above is not completely eliminated. The openings remain exposed at the front face of the socket and seem to hold some kind of attraction to small children, and by merely inserting a pointed member into the earth opening the shutter is easily displaced to permit access to the power contacts.

The present invention aims at an electric outlet socket device of enhanced security, and according to the invention there is provided an electric socket outlet comprising a fascia member having a plurality of openings for the pins of an electric plug to enter and pass into co-operation with respective socket contacts, an inner shutter device arranged between the fascia member and socket contacts normally to close off access to the line contacts and to permit such access upon engagement of an appropriate plug with the socket, and an outer shutter mounted at the front face of the fascia member for sliding movement between a closed position covering said openings and an open position in which the openings are exposed for entry of the plug pins.

With a socket according to the invention, with the outer shutter closed during periods when the socket is not in use, the socket openings are hidden completely by the outer shutter and the socket has an essentially solid appearance. As a result it is believed the socket will not attract the same interest from a child as the known sockets with permanently exposed holes. Furthermore, access to the power contacts is more difficult since it is necessary for two shutters operated in different ways to be opened first. The socket of the invention also has the additional attendant advantage of improving the aesthetic qualities by hiding the openings from view.

It is expedient for the outer shutter to be received in a recess in the front face of the fascia member so that its front surface does not protrude from and is preferably substantially flush with that of the fascia member. This construction allows the shutter to underlie the body of a plug engaged with the socket without impeding the plug, which means that the distance through which the shutter must be moved between the closed and open positions can be small and the shutter can be located inside the peripheral edge of the fascia member at all times.

The outer shutter is preferably biased by a spring to the closed position so that it is closed automatically on removing a plug from the socket and the shutter must be moved against the spring force to gain access to the openings. In a preferred construction the outer shutter consists of a T-shaped plate which is slidably mounted in a shallow recess of similar configuration in the front surface of the fascia member.

To assist in opening the outer shutter the front face of the fascia member may include a groove arranged to guide a pin, preferably the earth pin of a plug into abutment with the shutter for moving it to the open position with the pin.

It is well known to provide in an electric socket outlet a switch which controls electrical connection between a contact of the switch and a current conducting element which is connected to the electricity supply. In these known socket outlets, however, a plug can be inserted and removed whether the switch is turned "on" or "off". As a result arcing can occur between the contacts of the plug and socket and electric shocks can be suffered if the plug pins are touched with the fingers acidentally during plug insertion or removal operations. Furthermore, because the switch may be "on" during periods of non-use of the socket outlet, sharp instruments inserted through the socket openings may still make contact with live parts so problems of safety still persist.

In accordance with a second novel aspect the present invention avoids these drawbacks by providing a socket outlet according to any one of claims 1 to 8, wherein a switch is included and has an operating member protruding through the fascia member, the switch being operable to make and break electrical connection between a line contact and a current conducting element of the socket outlet, and the switch being so arranged that it can only be turned "on" to make said connection when a plug is inserted in the socket outlet.

According to a preferred arrangement an interlock device is provided in the form of a movable member displaced by one of the plug pins, preferably an earth pin, the interlock member blocking the switch operating member against movement to the "on" position when there is no plug inserted in the socket outlet.

A better understanding of the invention will be had from the following detailed description of a socket embodied in a bus duct distribution system, reference being made to the accompanying drawings in which.

Figure 8A:
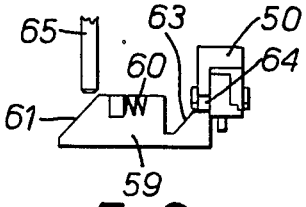
Figure 8B:
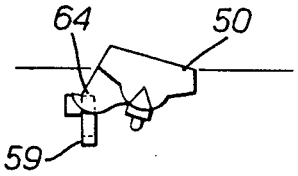
Figure 9A:
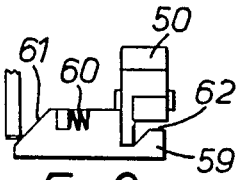
Figure 9B:
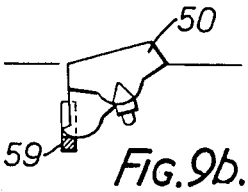

FIGS. 8*a* and 8*b* are side and end views illustrating the switch interlock with the switch off and prior to insertion of a plug into the socket; and FIGS. 9*a* and 9*b* are corresponding views showing the interlock with a plug inserted and the switch turned on.

Figure 1:
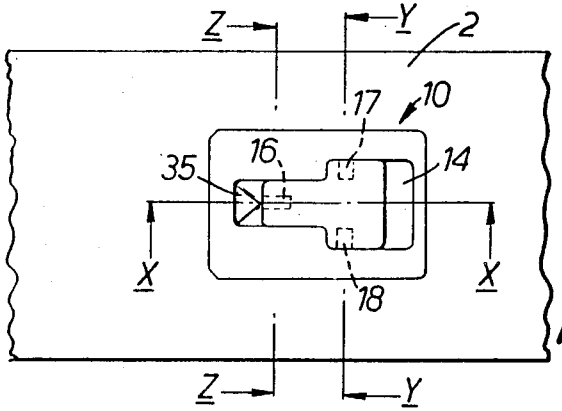
FIG. 1 is a front elevation of a section of ducting incorporating a socket in accordance with the invention.
Figure 2:
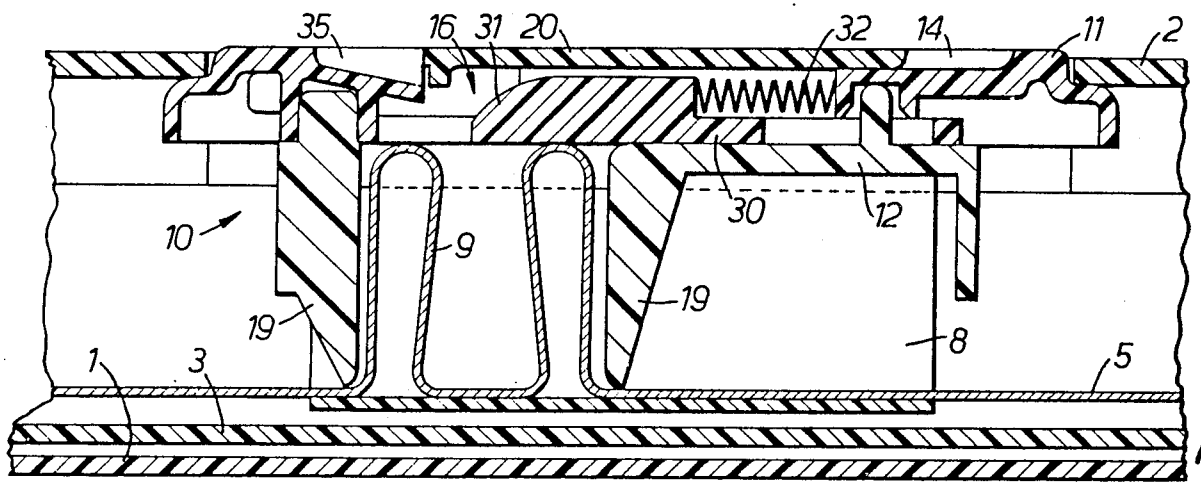
FIG. 2 is a section taken along the line X—X of FIG. 1.
Figure 3:
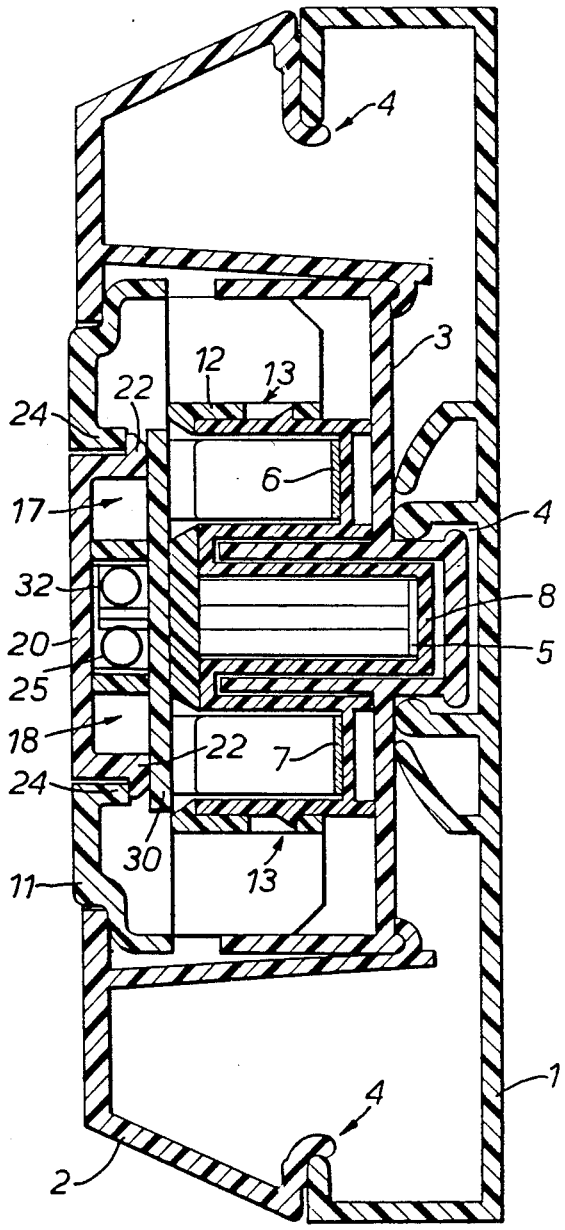
FIG. 3 is a section taken along the line Y—Y of FIG. 1.
Figure 4:
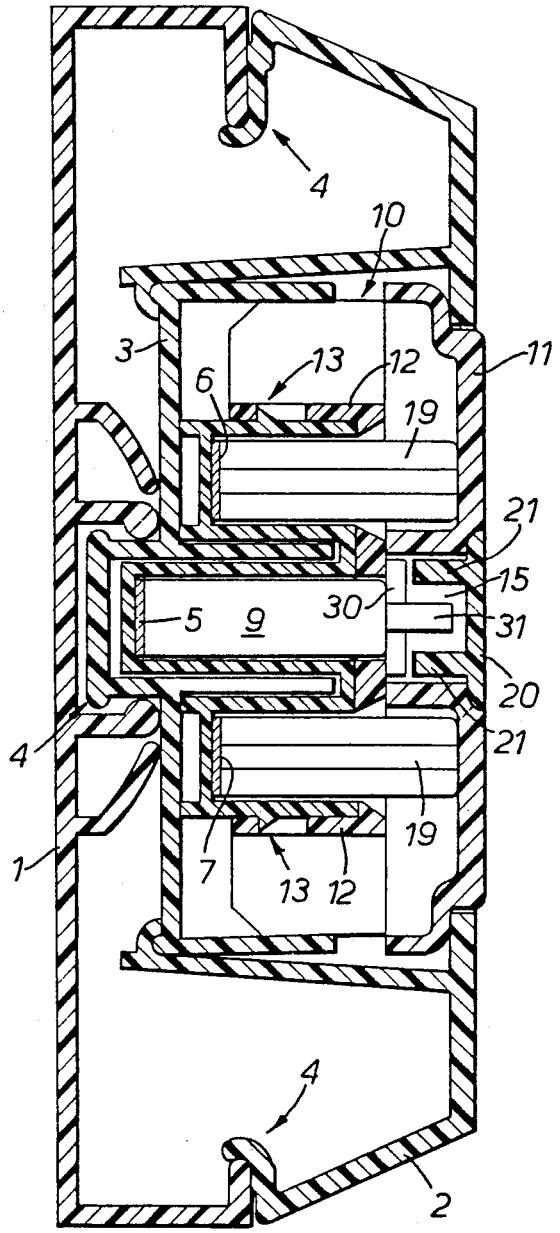
FIG. 4 is a section taken along the line Z—Z of FIG. 1.

The distribution duct illustrated in FIGS. 1 to 4 has an outer casing including a rear member 1 and a front cover 2 both formed as continuous extrusions. Within the outer casing is disposed an inner casing member 3 also formed as an extrusion, the member 3 being supported by the cover 2 and the cover 2 and member 3 both having snap-fit connections 4 with the rear casing member 1. The ducting is intended to be mounted to a wall, e.g. close to the floor to form a skirting, the rear member 1 being first secured in position and then having the inner casing member 3 and cover 2 fitted to it. The inner casing member defines three longitudinal channels along which extend respective conductor strips, namely an earth strip 5, a live strip 6 and a neutral strip 7. At positions spaced apart along the casing socket outlets are provided, only one being shown in the duct section seen in FIG. 1, to provide access for an electric plug to make contact with the conductor strips. At each outlet position the cover 2 is provided with a rectangular aperture, an electrically insulating insert 8 is disposed between the inner casing member 3 and the conductor strips 5–7 to hold them in proper position, and each strip is formed with two spaced apart upstanding U-shaped portions defining socket contacts for cooperation with the respective contact pins of an electric plug. The U-shaped contact portions for the earth strip 5 are seen in FIG. 2 and are designated with the numeral 9. Located within the casing at each outlet position is a socket 10 having a fascia plate 11 shaped to protrude through the aperture in the cover 2, and a body 12 firmly fixed to the fascia plate and having snap-fit connections 13 with the insert 8. The body includes pairs of tongues 19 which project down into the respective channels of the insert 8 either side of the contact portions of each conductor strip thereby to provide additional support for these conductor portions, as shown in FIG. 2 for the earth strip. In the front surface of the fascia plate is a shallow recess 14 of T-shape, and provided in the bottom of the recess are a longitudinal slot 15, and openings 16–18 to receive the earth, live and neutral contact pins of a conventional 3-pin plug, the openings 16–18 being located in register with the contact portions of the conductor strips 5–7 respectively. An outer shutter plate 20 also of T-shape is received in the recess 14 and is guided for longitudinal sliding movement by rails 21 which engage in the slot 15, and by latching projection 22 which snap behind inturned edges 24 of the fascia plate to secure the shutter to the fascia plate. The shutter is movable between the closed position shown in FIG. 1 in which it covers the openings 16–18 and an open position in which the openings are uncovered. The outer surface of the shutter is flush with that of the fascia plate so as not to impede engagement of a plug body flat against the socket surface. A spring 25 interposed between opposed abutment shoulders on the fascia plate and outer shutter 20 urges the latter towards the closed position.

Mounted slidably between the fascia plate 11 and body 12 is an inner shutter 30 also of T-shape configuration, and the opposite arms of which are arranged to underly the socket openings 17–18 to deny access to the power conductors 6,7 when the shutter is closed. The shutter 30 is guided for longitudinal movement by the side walls of the slot 15 in the fascia plate, and includes an integral nose portion 31 arranged to underlie the earth contact opening 16 when the shutter is closed. The nose portion has a curved cam surface which is adapted to be engaged by an earth contact pin inserted through the opening 16 for the shutter to be displaced in an open position in which access to the contact portions of conductors 6,7 is possible. The shutter is normally urged to the closed position by a spring 32 positioned between opposed abutment shoulders on the shutter 30 and the fascia plate.

The recess 14 in the fascia plate 11 includes an end part with side and end surfaces which slope inwardly towards the opening 16 to define a groove 35 to assist in guiding an earth pin into abutment with the adjacent end of the outer shutter 20 and then into the opening 16 for opening the inner shutter.

In the normal position when the socket is not in use both shutters 20,30 are closed to deny access to the conductors 6,7, and the socket openings 16–18 are also hidden by the outer shuttter 20. When a plug is to be inserted into the socket, the tip of the earth pin, which is slightly longer than the current carrying pins, is positioned in the groove 15 of recess 14 and is moved to slide the shutter 20 back against the force of spring 25 so as to uncover the openings 16–18. The earth pin is then pushed through the opening 16 to engage and slide back the inner shutter 30 allowing the current pins of the plug to pass through the openings 17, 18 and into contact with the contact portions of conductors 6,7, the earth pin itself coming into cooperation with the contact portions 9 of the earth conductor 5. When the plug is withdrawn from the socket the inner and outer shutters are returned automatically to their closed positions by the spring 25,32.

Although the outer sliding shutter of the invention has been described specifically in relation to a socket embodied in a distribution bus duct, it will be understood that it is equally applicable to separate outlet sockets of the type connected to the mains supply by electric cable. Such a socket is illustrated in FIGS. 5–9 and the outer shutter 20 may be conveniently mounted slidably on the outside of the fascia plate 11 in essentially the same manner as described above in connection with FIGS. 1 to 4 or in any other way.

Figure 7:
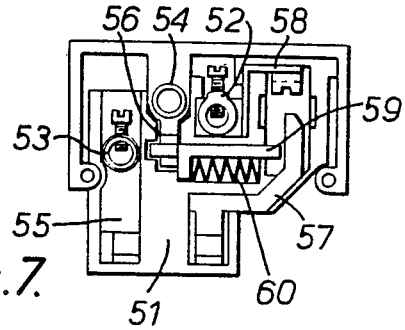
FIG. 7 is a front view of the outlet socket of FIG. 5 with the fascia, inner shutter, switch rocker, and moving contact removed.

The socket outlet of FIGS. 5–9 includes a switch which is operated by means of an actuating member in the form of a rocker 50 which protrudes through an opening in the fascia plate 11. The switch mechanism is housed within a body 51 attached to the rear of the fascia plate. As seen in FIG. 7, the body 51 also accommodates terminals 52–54 for the connection of the live, neutral and earth wires, respectively, of a mains supply circuit. A neutral contact 55 is connected to the terminal 53 and an earth contact 56 is connected to the terminal 54. Connected to the terminal 52 is a conducting element 58 which is also connected to the moving contact of the switch (not shown). The moving contact is movable by means of the rocket 50 between an "off"

position in which it is disengaged from a live contact 57 and an "on" position in which it engages this contact to establish electrical continuity between the contact 57 and terminal 52. It will be understood that the contacts 55–57 include pin contacting portions located behind the fascia plate in register with the openings in the fascia plate for cooperation with the respective pins of a plug when it is inserted into the socket outlet.

To prevent the switch being turned on when a plug is not inserted into the socket outlet an interlock device is provided. This device comprises a slide member 59 guided for linear sliding movement in the socket body and urged to a switch blocking position (FIG. 8) by a spring 60. At one end the member 59 is provided with a cam surface 61 and at its other end includes a stop shoulder 62 and a further cam surface 63. In the blocking position of member 59, the cam surface 61 is located in alignment with the pin contacting portion of the earth contact 56, and the stop shoulder is located beneath an integral finger 64 provided on the rocket 50 whereby the rocker is prevented from being moved to the "on" position to make the connection between contact 57 and element 58. Thus, the live contact 57 remains isolated from the mains supply. When a plug is inserted into the socket the earth pin 65, after first moving the outer shutter 20 as well as the inner shutter (not shown) to the open positions, engages the cam surface 61 and drives the slide member 59 against the bias of spring 60 to a switch released position (FIG. 9) as the plug is pushed fully home into the socket outlet. The finger 64 of rocket 50 is now aligned with a recess in the slide member and the rocker can be manipulated to close the switch. In this position of the slide member the switch can be operated in conventional manner to control supply of electric power to the plug engaged with the socket.

If an attempt is made to remove the plug with the switch still on, as the earth pin 65 is withdrawn the spring 60 pushes the slide member back towards the blocking position and the cam surface 63 acts on the finger 64 pivoting the rocker 50 into the "off" position and thereby breaking the connection between contact 57 and element 58 before the live and neutral pins of the plug leave the contacts 57 and 55 of the socket. Further movement of the slide member 59 under the force of spring 60 positions the shoulder 62 beneath the finger 64 to stop the switch being turned on. Thus, the switch can only be turned on when a plug has been inserted into the socket outlet, and if attempt is made to withdraw a plug when the switch is on it is automatically turned off.

Figure 5:
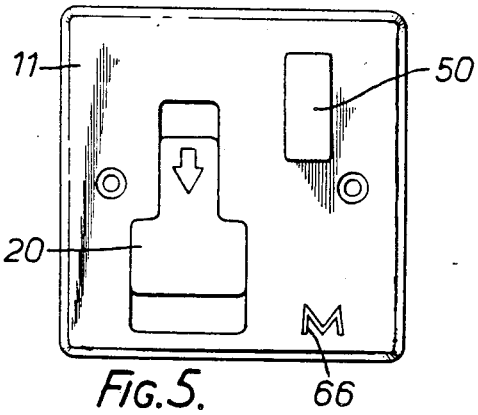
FIG. 5 is a front view showing a socket outlet having an outer shutter according to the invention and also including a switch.
Figure 6:
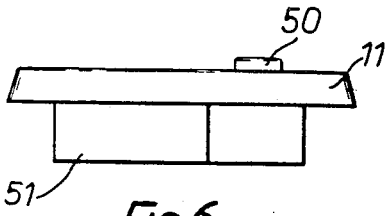
FIG. 6 is a side view of the socket outlet shown in FIG. 5.

As shown in FIG. 5, the socket outlet is provided with a neon indicator lamp 66 which is illuminated when the switch of the socket is turned on.

I claim:

1. An electric socket outlet comprising a fascia member having a plurality of openings for the pins of an electric plug to enter and pass into cooperation with respective socket contacts, a switch having an operating member protruding through the fascia member, the switch being operable to make and break electrical connection between a line contact and a current conducting element of the socket outlet, and an interlock device cooperating with said switch operating member so that said operating member can be moved to an "on" position to make said connection only when a plug is inserted in the socket outlet, said interlock device being arranged to be actuated to allow the switch to be turned to the "on" position by a pin of the electric plug.

2. A socket outlet according to claim 1, wherein the interlock device is arranged to be actuated by an earth pin of the plug.

3. A socket outlet according to claim 1, wherein the interlock device is arranged to turn "off" the switch if attempt is made to remove a plug from the socket outlet with the switch in the "on" position.

4. A socket outlet according to claim 1, wherein the interlock device comprises an interlock member movable between a blocking position in which said member obstructs movement of the switch operating member to the "on" position, and a switch releasing position in which the operating member is free to move between the "on" and "off" positions.

5. A socket outlet according to claim 4, wherein the interlock member includes a cam surface for engaging the switch operating member and moving said member to the "off" position as the interlock member is displaced from the switch releasing position to the blocking position.

6. A socket outlet according to claim 4, wherein the interlock member is biased towards the blocking position by spring means.

7. A socket outlet according to claim 6, wherein the interlock member is mounted for linear sliding movement between the blocking and switch releasing positions.

8. An electric socket outlet comprising a fascia member having a plurality of openings for the pins of an electric plug to enter and pass into cooperation with respective socket contacts, and an outer shutter mounted at the front face of the facia member for sliding movement between a closed position covering said openings and an open position in which said openings are exposed for entry of the plug pins, and further comprising a switch having an operating member protruding through the fascia member, the switch being operable to make and break electrical connection between a line contact and a current conducting element of the socket outlet, and an interlock device cooperating with said switch operating member so that said operating member can be moved to an "on" position to make said connection only when a plug is inserted in the socket outlet, said interlock device being arranged to be actuated to allow the switch to be turned to the "on" position by a pin of the electric plug.

9. A socket outlet according to claim 8, wherein the interlock device is arranged to turn "off" the switch if attempt is made to remove a plug from the socket with the switch in the "on" position.

* * * * *